US005456364A

United States Patent [19]

Lambert

[11] Patent Number: 5,456,364

[45] Date of Patent: Oct. 10, 1995

[54] POWERED SCREENING APPARATUS

[76] Inventor: Gene F. Lambert, 2023 Cochran Rd., Maryville, Tenn. 37801

[21] Appl. No.: 127,627

[22] Filed: Sep. 27, 1993

[51] Int. Cl.[6] ..... B07B 1/54

[52] U.S. Cl. ..... 209/382; 209/320

[58] Field of Search ..... 209/381, 382, 209/320, 352

[56] References Cited

U.S. PATENT DOCUMENTS

| | | | |
|---|---|---|---|
| 2,032,082 | 2/1936 | Deister et al. | 209/382 |
| 2,532,734 | 12/1950 | Schmidt | 209/382 |
| 3,285,413 | 11/1966 | Taylor-Smith | 209/382 |
| 5,232,099 | 8/1993 | Maynard | 209/381 |

FOREIGN PATENT DOCUMENTS

| | | | |
|---|---|---|---|
| 2701341 | 7/1978 | Germany | 209/382 |

*Primary Examiner*—Kenneth Noland

[57] ABSTRACT

A powered screening apparatus having a pair of spaced elongated side members, a screen surface supported between the side members, a frame member supported between the side members and beneath the screen surface, a first hammer mounted to the side members beneath the screen surface, a second hammer mounted to the frame member, a first vibrator attached to one of the side members and the second hammer and a second vibrator attached to the other side member and the second hammer. The apparatus is equipped to permit the side members to vibrate independently of each other.

9 Claims, 4 Drawing Sheets

14
66
54
16
22
56
58
64
60
12
68

POWERED SCREENING APPARATUS

BACKGROUND OF THE INVENTION

The present invention relates to a powered screening apparatus, and more particularly, to a vibrating screen used to separate and sort multiple size solids and particulates.

Vibrating screen arrangements have been in use for many years in gravel and rock quarrying for screening and/or for dewatering wet material. Generally, the arrangements comprise a working member supported on a frame and an exciter arranged to impart vibrating motion to the member. The working member is fitted with a screen deck with a conventionally rigid aperture element which may be made up of a plurality of screening panels.

Despite the fact that the working member is vibrated in use, blinding of the apertures in the screening material often occurs. When blinding occurs, separation of particulates become less uniform and less efficient. It is, therefore, an object of this invention to reduce blinding and improve efficiency.

Vibrating screen decks have also been widely in use in the past for separating particulates of various sizes and composition. Such screening decks typically comprise a rectangular frame suspended in operation with screen cloth mounted within the frame from which the materials are separated. The frame and screen in such decks are suspended at an angle. The entire frame is vibrated, thus imparting vibration to the machine which in turn causes the solids to move down the screen. As the materials move down the vibrating screen, the solids of smaller mesh size pass through the screen with larger solids discharged from the lower end of the screen.

One disadvantage of such prior screening devices is imparting vibrating motion to the entire system without a corresponding reduction in the blinding. Another disadvantage of the prior screening devices is that they require sufficient power to throw or move the solids along the vibrating screen. Still another disadvantage is that prior decks have to be built with heavier structural members to withstand the throwing of material and the increased power. Since prior screening devices are much heavier, structures to support them have to be much heavier and are more costly to construct. Another disadvantage is that prior screening devices have to be built substantially larger with greater screening area to produce the same amount of separated material as the present invention. Accordingly, it is an object of this invention to reduce the size and weight of the screening device needed to produce equivalent qualities of separated material. Prior screening devices are less inclined to enhance the separating efficiency of the device. The present device may be mounted at steeper angles and still maintain its efficiency. Gravity assists the movement of the material over the screen, which in turn requires less power to activate the present device. Decks of this size can typically employ motors of forty horsepower (40 hp) or more. Accordingly, it is an object of this invention to provide a device which is less costly to operate. Another disadvantage of such prior decks is the susceptibility of frequent maintenance because the vibration is imparted to the entire deck for sustained lengths of time. It is, therefore, an object of this invention to reduce maintenance caused by vibration.

Other screening apparatus have been developed which attempt to reduce the substantial energy requirement required in such devices and increase the frequency at which the screening surface vibrates. In these apparatus, a plurality of smaller vibrator motors have been employed which are coupled to vibrator shafts extending beneath the screen material at various locations spaced along the length of the screen. The vibrator shafts are coupled by relatively complex linkages to the vibrator motor on the exterior of the frame of the deck. A plurality of vibrator shafts or arms are positioned on the shaft which move eccentrically to vibrator screen from beneath. This particular vibrator arrangement in such decks necessitates relatively complex linkages and causes localized tapping of screen both of which result in concentrated wear. Such prior screening decks require frequent adjustment to keep the screen in contact with the vibrators. Such prior screening decks are also susceptible to frequent blinding. Such prior screening decks require the vibrators to run at relatively high rotating speeds (4,000 rpm to 45,000 rpm) to achieve the desired frequency. The high rotating speed decreases the life of bearings which increases maintenance or operating costs. In such prior screens, the screen is vibrated once per revolution. The present invention vibrates the screen twice per revolution, which increases screening efficiency. It is, therefore, an object of this invention to reduce the necessity for frequent adjustment, reduce operating costs, and increase the efficiency of the screening deck.

SUMMARY OF THE INVENTION

According to the invention, a screening arrangement defining a feed end and a discharge end comprises a pair of elongated side members extending between the feed end and a discharge end, a pair of screen support members each attached to opposing elongated side frame members, at least one screen deck comprised of a flexible screen material extended between and secured to the screen support members, at least one frame support member attached at end to opposing side members, a first hammer means mounted to opposing sides of said side members, a second hammer means mounted to said frame support member and vibratably independent of said side frame members, and means to vibrate said first and second hammer means such that said first and second hammer means strike the screen material alternately. The screen apparatus may be held or supported at an angle with the discharge end lower than the feed end, thus permitting the screen material to form a downward slope which in turn permits particulates which do not fall through the screening material to be discharged through the lower end or discharge end.

These and other objects, features and advantages of the present apparatus will be clearly understood to those skilled in the art.

DESCRIPTION OF THE PREFERRED EMBODIMENT

Figure 1:
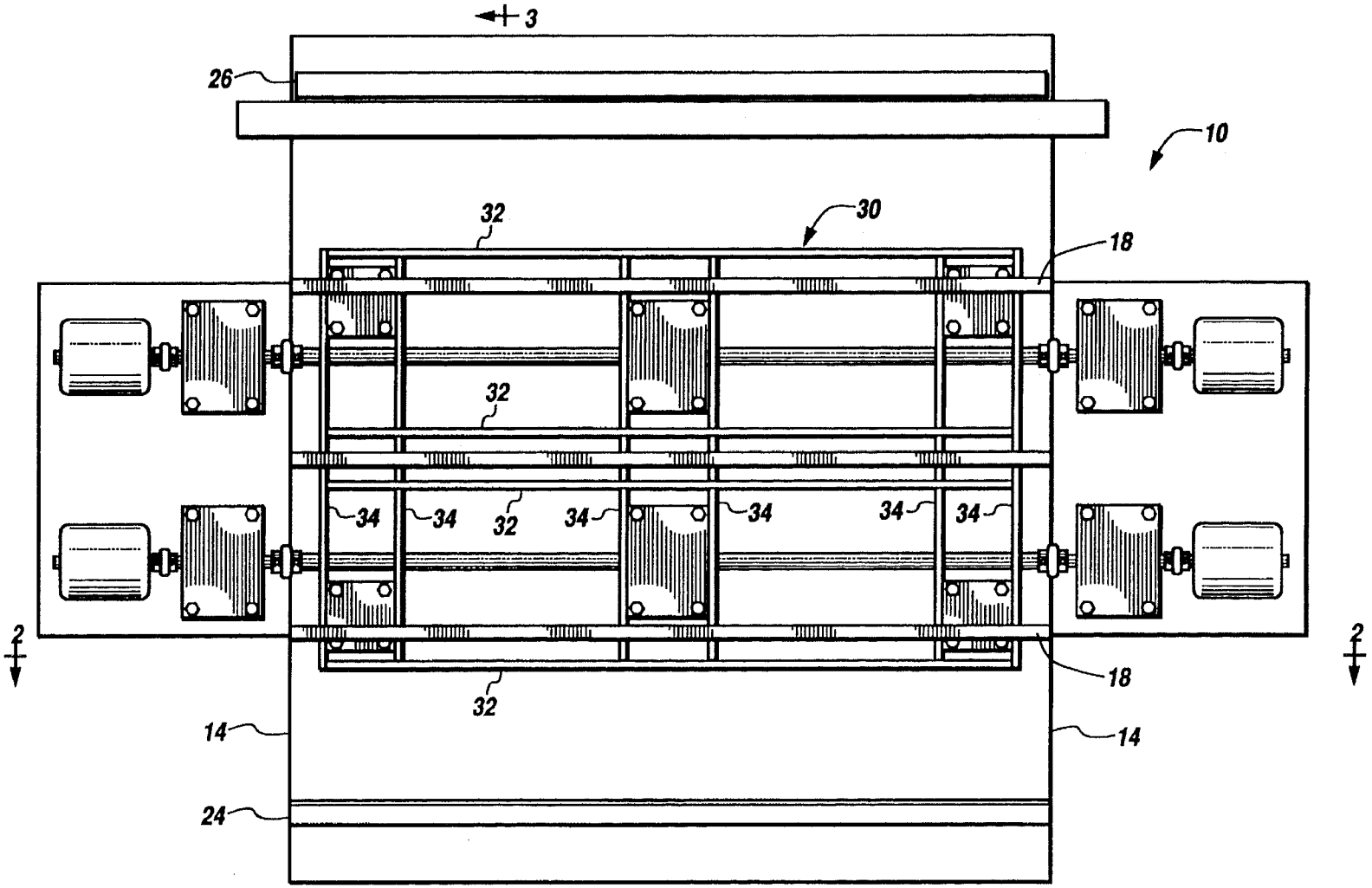
FIG. 1 is a top view of the preferred embodiment of the Powered Screening Apparatus showing the components of the apparatus.

An overall view of the Powered Screening Apparatus is shown in FIG. 1.

Figures 2A, 2B, 2C:
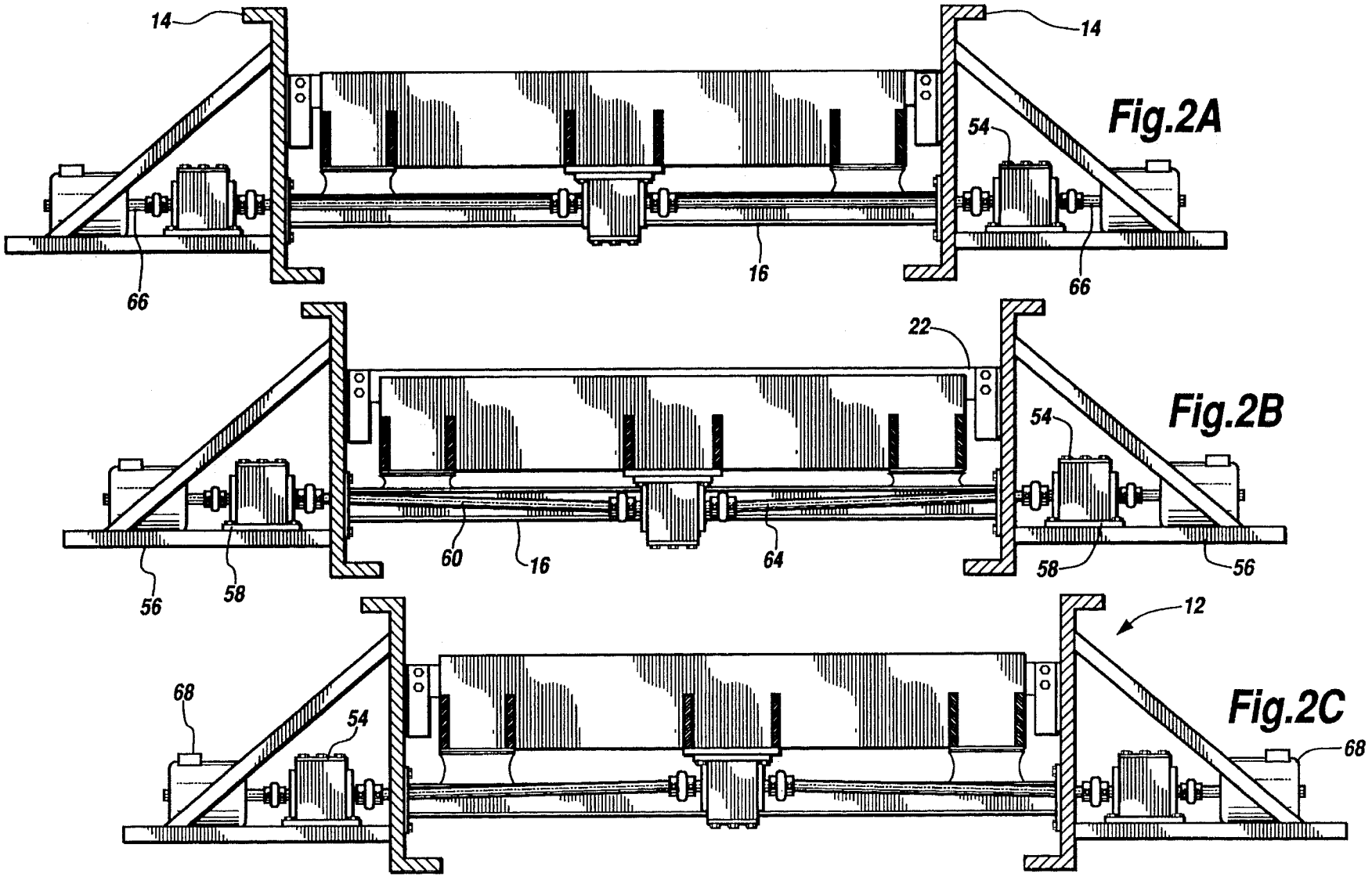
FIG. 2A is a cross-sectional and elevational view of the Powered Screening Apparatus as viewed substantially along line 2—2 of FIG. 1 showing both the primary and secondary hammer assemblies in contact with the screening material.
FIG. 2B is a cross-sectional and elevational view of the Powered Screening Apparatus as viewed substantially along line 2—2 of FIG. 1 showing the secondary hammer assembly withdrawn from the screening material.
FIG. 2C is a cross-sectional and elevational view of the Powered Screening Apparatus as viewed substantially along the line 2—2 of FIG. 1 showing the movable hammer assembly above the primary hammer assembly and in contact with the screening material.

The screen apparatus 10 comprises a rigid frame generally 12, having a pair of longitudinally extended elongated side members 14 such as channel beams shown in FIG. 1 and 2A. The elongated frame members 14 are held apart and spaced in generally parallel relationship to each other by transverse members 16 as shown in FIG. 2A.

Second transverse members 18 are spaced generally parallel to members 16 and likewise hold elongated members 14 apart. Said second members 18 also provide support for the screening material 20. The upper edge 22 is equipped with hammer 23 which selectively imparts vibration to screen 20. Members 18 are held by flanges 28 which are attached to opposing side members 14.

Screening material 20 is contained within frame 10. Solids and particulates pass over the screening material to be separated. The screening material is held in place by C-shaped members 24 and 26. The screening material 20 is placed above and over transverse members 24. Members 24 and 26 are attached conventionally such as by welding to opposing sides 14 and generally parallel to transverse members 16.

A means for imparting motion and vibration to the screening material is generally shown at 30. Side members 32 are provided and run generally perpendicular to side members 14 and parallel to transverse members 18. Parallel side members 34 are attached at spaced intervals to members 32 to form essentially a generally rectangular surface. The upper edge 35 of members 34 has a hammer surface 37 which selectively contacts the under side of screen material 20. The lower edge 36 of side member 34 is attached to resilient isolators 38 by means of a flange plate 40. The isolator 38 is attached to a second flange plate 42. Flange plate 42 is attached to upper sides 44 of transverse members 16.

A means to excite or vibrate the hammer assembly 30 is provided at 46. A pair of inner vibrators 48 are provided. A flange plate 50 is bolted to a second flange 52. Flange 52 is attached to parallel side members 34 at their lower edges 36.

A second set of vibrators 54 is provided and mounted outboard of elongated side members 14. A plate form 56 is rigidly attached to the outer side members 14. A flange plate 58 is attached to the plate form 56. Shafts 60 and 64 rotatively connect vibrators 54 and 48. Shafts 66 rotatably connect conventional electric motors 68 to each vibrator 54 vibrator 54 inparts vibration to members 14.

Means to isolate the apparatus is provided. A pair of brackets 70 are rigidly attached to the outer sides 72 of both members 14. Isolators 74 support the screen apparatus at a generally inclined angle such that the loading end 76 is relatively elevated above discharge end 78. Conventional posts 80 are selectively elevated to hold the screening apparatus. It will be appreciated by those skilled in the art that the design isolates the vibrations of the screening apparatus from the posts.

An important feature of the present invention is controlling the frequency and amplitude of the screen vibration over the length of the screen during operation. Various materials separate better at different frequencies and amplitudes. Accordingly, the ability to control the frequency and amplitude is a desired quality of the present invention. To this end, the vibrators may be adjusted in order to impart the ideal amplitude at various locations along the screening material by adjusting the vibrators. It will be recognized by those skilled in the arts that adjusting the counter weights in the vibrator will increase or decrease the amplitude and increasing or decreasing the speed will increase or decrease the frequency.

Vibration control circuits for motors 68 have not been shown because they are within the selection of one skilled in the art from a wide range of speed controls which have been employed for other purposes. It will be recognized by those skilled in the art that varying the speed of motor 68 will provide additional control of the frequency and amplitude of strikes imparted to screen material 20.

The operation of the variable screening apparatus according the invention is as follows:

The bulk material is loaded at the elevated loading end onto the top of screening surface 20. As a result of the striking imparted to the screening material, the material moves downward along the screening surface 20. As the material moves over the screening material 20, smaller particles drop through the apertures in the screening material 20. Particles which are too large to drop through the apertures are discharged at discharge end 78.

Figure 3A:
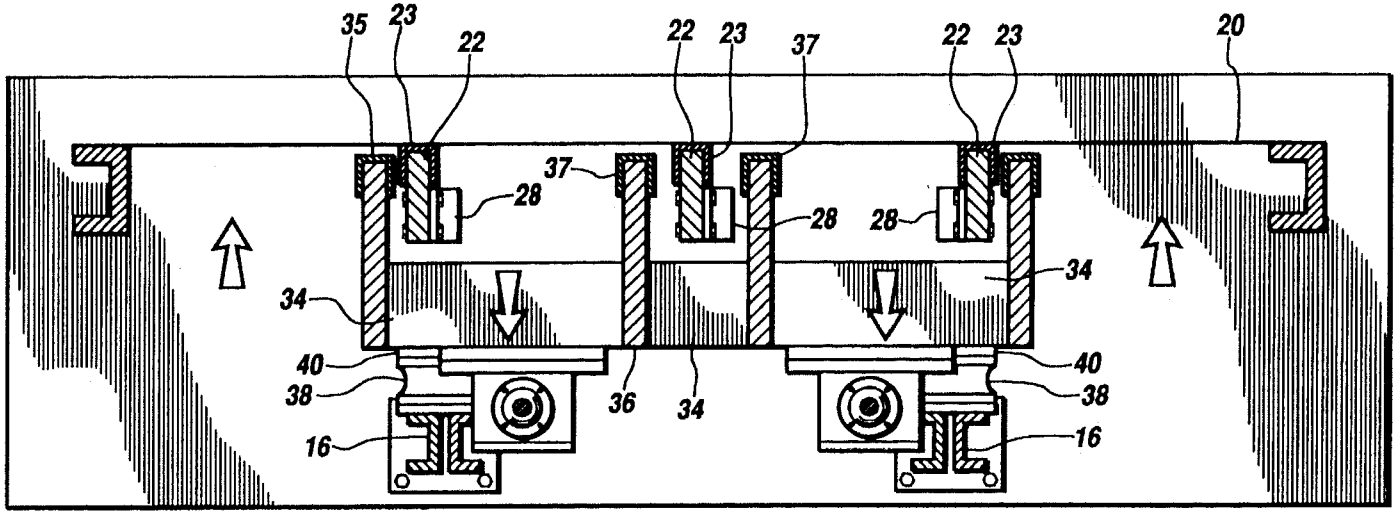
FIG. 3A is a cross-sectional and elevational view of the Powered Screening Apparatus as viewed substantially along the line 3—3 of FIG. 1 showing the primary hammer assembly in contact with the screening material and the secondary hammer assembly withdrawn from the screening material.
Figure 3B:
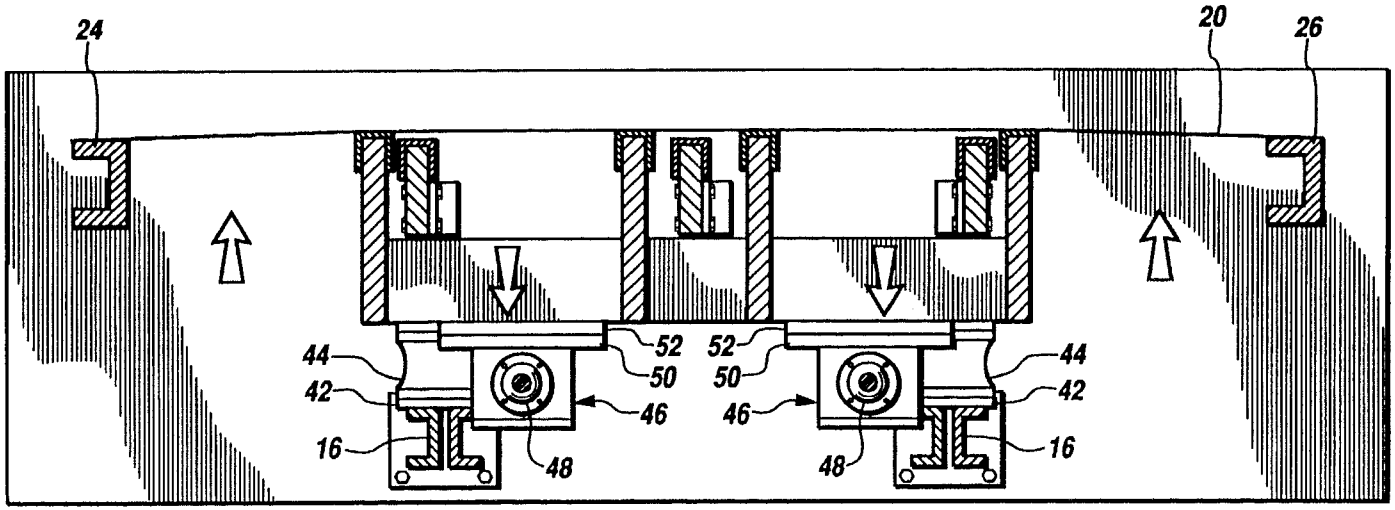
FIG. 3B is a cross-sectional and elevational view of the Powered Screening Apparatus as viewed substantially along line 3—3 of FIG. 1 showing the secondary hammer assembly in contact with the screening material and the primary assembly withdrawn from the screening material.
Figure 5:
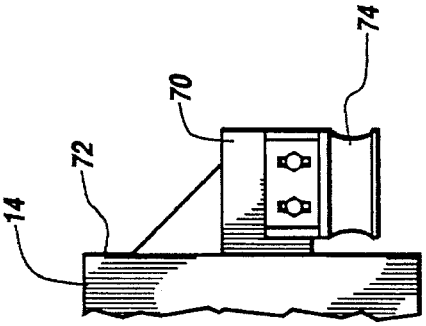
FIG. 5 is a detailed view of one of the support members shown in FIG. 4 to hold the Powered Screening Apparatus in operational position.
Figure 4:
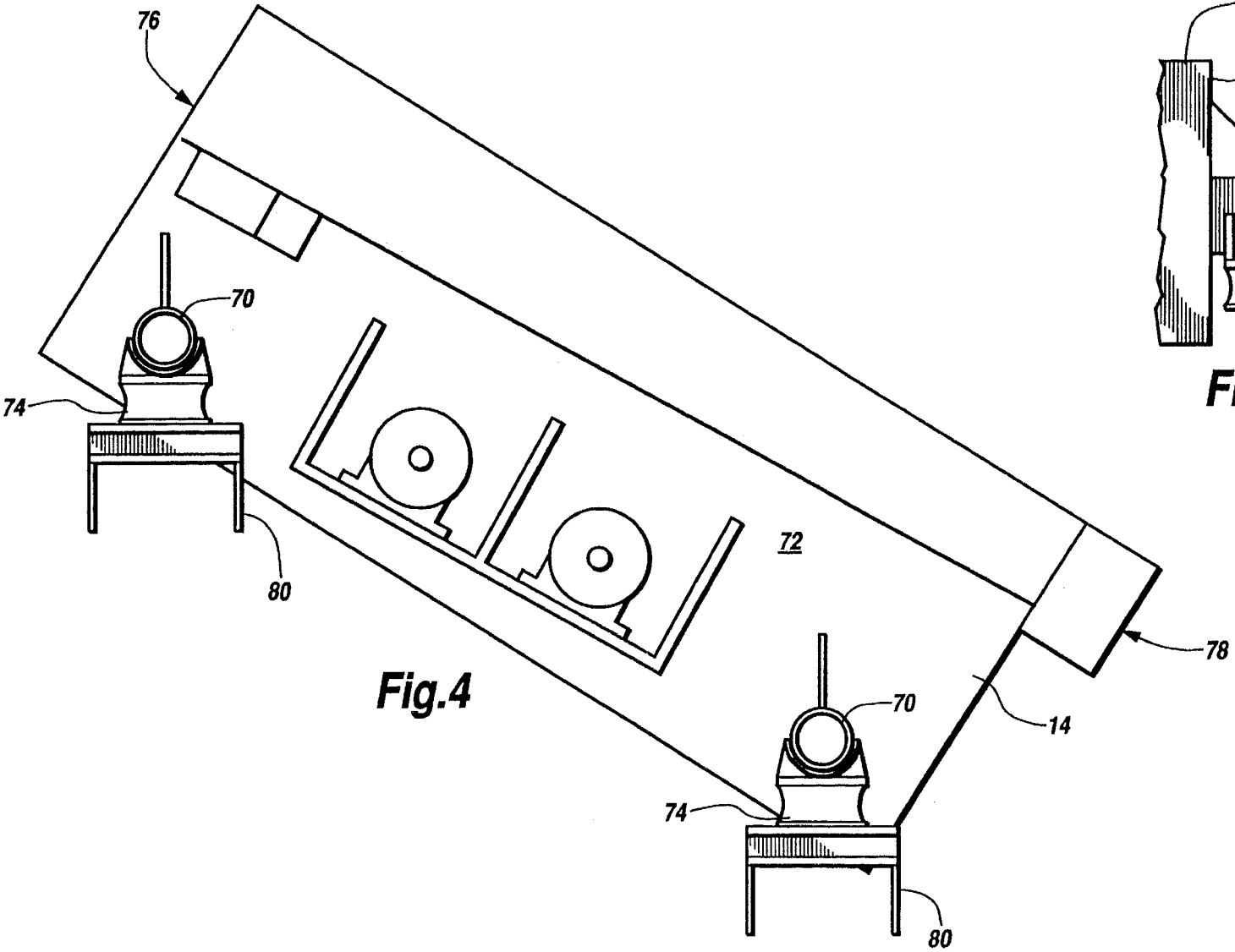
FIG. 4 is a side elevational view of the Powered Screening Apparatus showing the apparatus in its mounted and operational position.

The striking is imparted to the screening material by activating motors 68. Vibrators 48 are in 180 degree phase to vibrators 54. As the first hammer 22 strikes the under surface of screening material 20, the second hammer 37 is retracted from and out of contact with the under surface of screening material 20. This motion is illustrated in FIG. 3A. As the hammer 22 withdraws downward away from the underside of screening material 20, the second hammer 37 rises and strikes the underside of screening material 20. This motion is illustrated in FIG. 3B. The alternating motions of hammer 22 and hammer 37 are 180 degrees out of phase with each other. Accordingly, hammers 22 and 37 are not in contact with the underside of screening material 20 at the same time.

Although the invention is described and illustrated with reference to a specific embodiment thereof, it is to be expressly understood that it is in no way limited to the disclosure of such a preferred embodiment, but is capable of numerous modifications within the scope of the intended claims.

What is claimed is:

1. A Powered Screening Apparatus for separating bulk granulated material comprising:

a pair of spaced elongated side members;

a screen surface supported between said side members;

at least one frame member supported between said side members beneath said screen surface;

a first hammer means mounted to said side members beneath said screen surface and in partial contact with said screen;

a second hammer means mounted on at least one said frame member vibratably independent of said side members and in partial contact with said screen;

a first vibrator means fixed to a first of said side members and said second hammer means whereby vibration is imparted to said first said side member and said second hammer means; and a second vibrator means fixed to a second of said side members and said second hammer means whereby vibration is imparted to said second of said side members and said second hammer means and is vibratably independent of said first of said side members.

2. The Powered Screening Apparatus of claim 1 including support means mounting said second hammer means to said frame means isolating the vibrations of said second hammer means for said side member.

3. The Powered Screening Apparatus of claim 2 wherein said support means comprises resilient means mounted between said second hammer means and mounted between said frame members.

4. The Powered Screening Apparatus of claim 1, including a plurality of frame members, said first and second hammer means, and said first and second vibrator means mounted to said side members.

5. The Powered Screening Apparatus of claim 1 including a pair of screen anchoring means mounted on opposing sides of said side members.

6. The Powered Screening Apparatus of claim 1 wherein said vibrator means includes control means for varying the frequency and amplitude of said vibrator means.

7. The Powered Screening Apparatus of claim 5 wherein said anchoring means comprises an elongated channel mounted to each opposed side members.

8. A Powered Screening Apparatus for separating bulk granulated material comprising:

a pair of spaced elongated side members;

a screen surface supported between said side members;

at least one frame member supported between said side members beneath said screen surface;

a first hammer means mounted to said side members beneath said screen surface and in partial contact with said screen;

a second hammer means mounted on at least one said frame member vibratably independent of said members and in partial contact with said screen;

a second support means attached to said side members;

a first vibrator means fixed to said first of said side members and said second hammer means whereby vibration is imparted to said first of said side members and said second hammer means; and a second vibrator means fixed to said second of said side members and said second hammer means whereby vibration is imparted to said second of said side members and said second hammer means.

9. The Powered Screening Apparatus of claim 8 wherein said second support means includes at least one support bracket attached to each side member and at least one resilient pad attached to said support bracket.

* * * * *